United States Patent [19]

Baggett

[11] Patent Number: 4,685,517

[45] Date of Patent: Aug. 11, 1987

[54] PRESSURE DIFFERENTIAL PLUNGER

[76] Inventor: Jay W. Baggett, 1209 Shasta, McAllen, Tex. 78501

[21] Appl. No.: 693,589

[22] Filed: Jan. 22, 1985

[51] Int. Cl.[4] ..... E21B 43/00; E21B 34/12

[52] U.S. Cl. ..... 166/105; 166/325; 417/554

[58] Field of Search ..... 166/62, 68, 105, 319, 166/321, 325, 328; 137/539.5; 417/549, 554; 175/324

[56] References Cited

U.S. PATENT DOCUMENTS

| | | | |
|---|---|---|---|
| 50,898 | 11/1865 | Brown | 417/554 |
| 391,431 | 10/1888 | Shoff | 166/325 X |
| 1,900,731 | 3/1933 | Pippin | 417/549 |
| 1,923,040 | 8/1933 | Pippin | 417/549 |
| 2,097,629 | 11/1937 | Lowrey | 417/549 X |
| 3,947,158 | 3/1976 | Gage | 417/554 |

*Primary Examiner*—Stephen J. Novosad
*Assistant Examiner*—John F. Letchford
*Attorney, Agent, or Firm*—Arnold, White & Durkee

[57] ABSTRACT

The pressure differential plunger of the present invention is a hollow cylindrical member having an internal bore for the passage of fluid therethrough as the plunger is reciprocated within the barrel. The lower end of the plunger has a tapered or venturi throat leading into the bore to reduce turbulent flow. A ball-type pressure differential valve is mounted within and adjacent the top of the plunger. The cylindrical body of the plunger is configured to be slidably fitted within the pump barrel such that the seal provided by the slidably fitting metal surface of the cylindrical body and the pump barrel are positioned between the valve element and the lower end of the bore. The top of the plunger also has means for connecting the plunger to a conventional sucker rod.

2 Claims, 5 Drawing Figures

PRESSURE DIFFERENTIAL PLUNGER

BACKGROUND OF THE INVENTION

1. Field of the Invention

The present invention relates to a pump for an oil well. More particularly, the present invention involves a pump in the form of a pressure differential plunger.

2. Prior Art

Most people in the oil industry are familiar with the pump jack or walking beam type of pump which is used on oil wells. At the lower end of the well, pumping is effected by means of a plunger which reciprocates within a stationary barrel. At the surface, the external unit involves an arm which moves up and down and which is connected to a rod that goes into the ground. This rod is actually a series of sucker rods which connect at the bottom within the plunger which reciprocates within the barrel. Normally, the barrel will have a check valve in the form of a ball adjacent the bottom of the barrel. The prior art plunger also generally has a check valve in the form of a ball valve adjacent the bottom.

The present invention, on the other hand, involves a pressure differential plunger which can be used in conjunction with the pre-existing barrel. However, the plunger of the present invention has a tapered or venturi throat at its lower end to reduce turbulent flow. The plunger of the present invention also involves a pressure differential valve of the ball-type adjacent the top of the plunger.

The prior art does not show or suggest the features of the plunger of the present invention and, more particularly, the manner in which the pressure differential valve is mounted and operates within the plunger.

SUMMARY OF THE INVENTION

The present invention involves a pressure differential plunger of the type used in a down-hole pump for an oil well. The plunger itself is of a new design but it can be used in conjunction with a barrel of a pre-existing design. Accordingly, the description of the present invention will be in terms of the plunger.

The pressure differential plunger of the present invention is a hollow cylindrical member having an internal bore for the passage of fluid therethrough as the plunger is reciprocated within the barrel. The lower end of the plunger has a tapered or venturi throat leading into the bore to reduce turbulent flow. A ball-type pressure differential valve is mounted within and adjacent the top of the plunger. The top of the plunger also has means for connecting the plunger to a conventional sucker rod.

The upper end of the plunger is enlarged in the area above the ball. The ball is allowed to rest on a seat which has an internal opening slightly less than the internal bore of the main part of the plunger. In the enlarged chamber above the ball, there is a cage formed by a lower annular ring having an opening therethrough and resting on the seat around the ball. This opening in the annulus of the cage is large enough to permit the ball to move upwardly within the cage. The cage also includes three spaced vertical legs which extend to an upper end in the form of a spider. The center of the spider constitutes a hub which has a small central opening therethrough. The central opening in the hub slidably receives the stem of a retainer. The lower end of the retainer is provided with a circular head, the lower end of which has a spherical recess which is adapted to bear against the top of the ball. A spring bears against the head of the retainer and the hub to urge the ball lightly against its seat.

The fact that the space above the ball has a larger cross-sectional area than the cross-sectional area of the plunger itself, permits a gas or liquid to pass quickly past the ball into the space and then out through the top of the plunger. Since the diameter of the opening through the seat is smaller than the diameter of the main bore of the plunger, a venturi effect is created in the area of the seat and the velocity of the fluids through the seat is thereby increased. The vertical legs on the cage provide a guide to prevent chattering. The light loading of the retainer against the top of the ball also prevents spinning of the ball thereby reducing the possibility of wear. On the downstroke, the greater area through the cage eliminates pressure build-up on the top of the ball thereby allowing the ball to stay open and pass all of the gas that is flowing through the valve seat. At the end of the downstroke, the ball is urged into its seat by the action of the spring and the pressure of the fluid above the ball to allow for a full displacement upstroke.

DETAILED DESCRIPTION OF THE PREFERRED EMBODIMENTS

Figure 1:
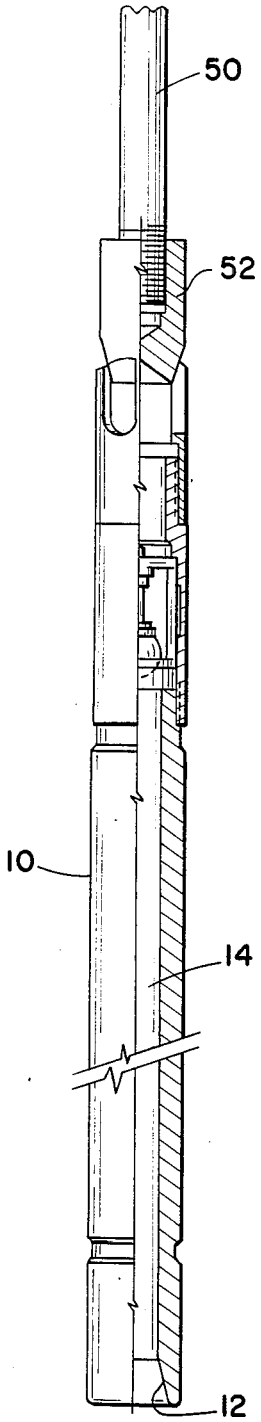
FIG. 1 illustrates a side partial cutaway view of the plunger body.

Referring to the drawings in detail, FIG. 1 shows a hollow, cylindrically-shaped plunger 10 which is adapted to reciprocate within a barrel or pipe joint (not shown). The barrel referred to above will be immersed in oil so that, when the lower end of the plunger 10 moves downwardly, oil will be forced into the interior of the plunger. The plunger has a main vertical bore 11 of essentially constant diameter throughout the majority of the vertical length of the plunger. However, the lower end of the bore 11 of the plunger is provided with an outwardly and downwardly beveled or tapered throat 12 to assist in the introduction of oil into the interior 14 of the plunger. The upper end of the plunger 10 connects with a valve rod 50 through a conventional rod connector 52. The upper end of the connector is threaded so as to receive the lower end of the rod 50; the lower end of the connector 52 is internally threaded so as to receive the threads 54 at the upper end of the plunger 10. The connector 52 has a plurality of ports (not referenced) intermediate its ends to permit fluid from the plunger to pass freely upwardy into the tubing string (not shown) connected to the top of the barrel (not shown).

Figure 2:
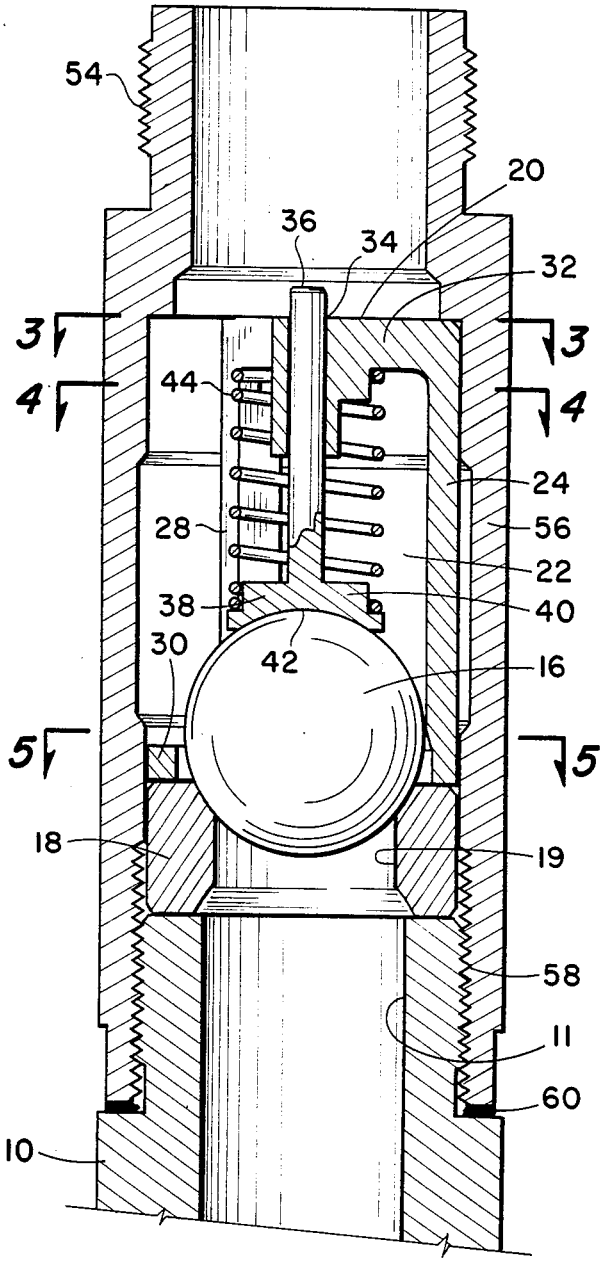
FIG. 2 illustrates a side cross-sectional view of the upper end of the plunger body, including the movable valve element.
Figure 3:
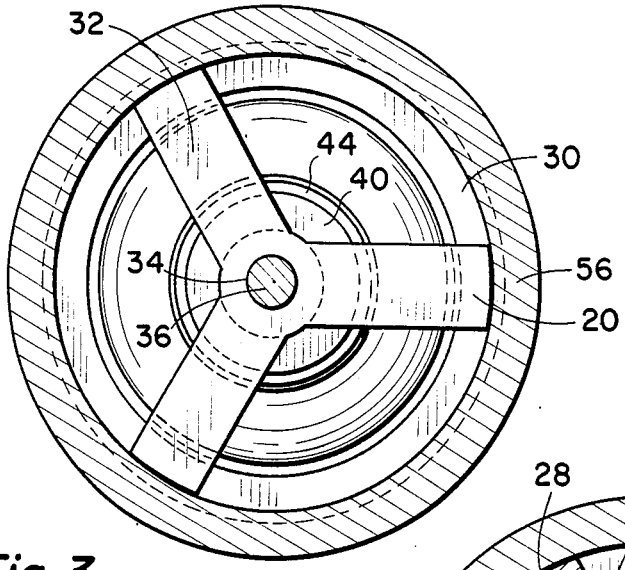
FIG. 3 illustrates a cross-sectional view of the plunger body as taken along plane 3—3 in FIG. 2.
Figure 4:
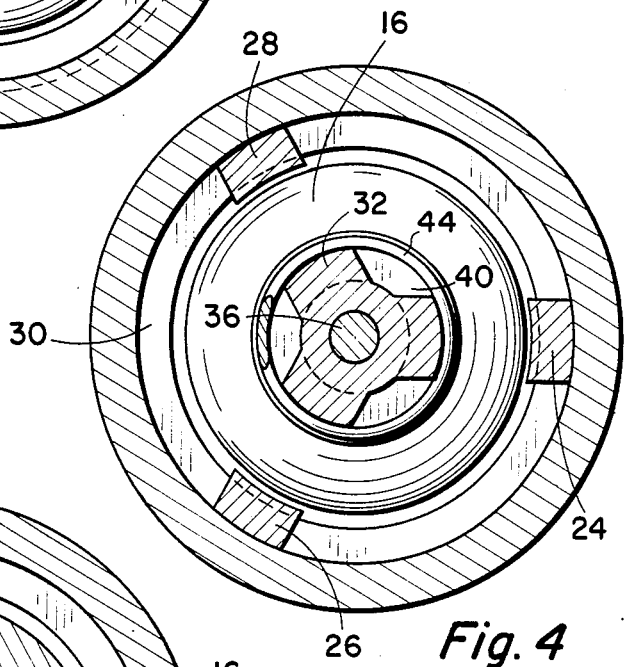
FIG. 4 illustrates a cross-sectional view of the plunger body as taken through plane 4—4 in FIG. 2.

Referring now to FIGS. 2, 3, and 4, the upper end of the plunger 10 is comprised of a sleeve 56 on which the male threads 54 are received. This sleeve 56 is preferably made of stainless steel. It is connected to the main plunger 10 by the threaded joint 58. Silver solder 60 is preferably inserted into the bottom of the joint between the joint sleeve 56 and the main plunger 10, the outer surface of the main plunger body 10 being slidably fitted within a plunger barrel, free of packing rings or other resilient seal elements.

Within the sleeve 56, a relatively movable valve element shown as a ball 16 rests against a relatively stationary valve element shown as a seat 18. Both the ball and the seat are preferably made of carbide steel. The seat 18 abuts the top interior of the plunger 10 as best shown in FIG. 2. However, the interior bore 19 of the seat 18 is smaller than the main bore 11 of the plunger 10 to create a venturi effect on fluids passing through the seat on the downstroke of the plunger. The upper end of the bore 19 of the seat is shown as being tapered or curved to conform with the lower mating surface of the ball; likewise the lower end of the bore 19 is similarly tapered or curved which makes the seat reversible. Of course, if the movable valve elemant 16 were a cone or tapered plug instead of a sphere or hemisphere, then these tapers would be without any curvature.

Figure 5:
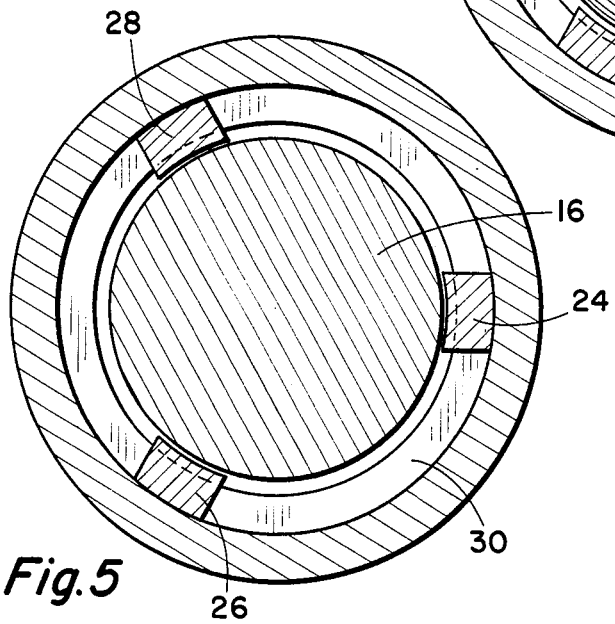
FIG. 5 illustrates a cross-sectional view of the plunger body as taken through plane 5—5 in FIG. 2.

The ball 16 is slidable within a cage 20 (preferably made of stainless steel) which has an opening 22 spaced between three longitudinal legs 24, 26 and 28. The relationship of the ball 16 to the legs 24, 26, and 28 can best be seen by reference to FIG. 5. The end 30 of the cage 20 adjacent the ball is in the form of an annulus through which the ball can pass the space 22 between the three legs. At the upper end, the three legs form a spider shaped hub 32. The center of the hub is provided with a hole 34 which receives the stem 36 of a retainer 38. The end of the retainer 38 adjacent the ball 16 is provided with a head 40 having a spherical recess 42 which is adapted to bear against the ball. A spring 44 bears against the head 40 and the inside of the hub 32 to urge the ball 16 lightly against the seat 18. The sleeve 56 holds the cage 20, the ball 16 and the seat 18 securely against the top of the plunger 10 as shown in FIG. 2.

The space 22 above the ball 16 has a cross-sectional area which is considerably larger than the cross-sectional area of the opening 11 in the plunger 10 below the ball, and also larger than the cross-sectional area of the opening 19 in the seat 18, the latter being smaller than the cross-sectional area of the opening through the plunger 10 for reasons explained above. The flow through the area 22 is approximately 33% greater than that through a standard API closed valve assembly. At the same time, the cage 20 which surrounds the ball, through its legs 24, 26 and 28 provides a guide of relatively close tolerances to stop chattering. The ball is also lightly spring-loaded to stop spinning. The spring 44 also prevents the ball-retainer assembly from banging against the hub 32 on the downstroke of the plunger 10.

Gas lock is eliminated by locating the spring-loaded pressure differential valve on top of the plunger 10. On the downstroke, the greater area through the cage 20 eliminates pressure build-up on the top of the ball allowing the ball to stay open and pass all of the gas that is flowing through the valve seat. At the end of the downstroke, the ball is urged towards its seat by the spring and the pressure of the fluid above the ball to allow for a full displacement upstroke.

Whereas the present invention has been described in particular relation to the drawings attached hereto, it should be understood that other and further modifications, apart from those shown or suggested herein, may be made within the spirit and scope of this invention. For example, although the relatively movable valve element 16 has been shown in the drawings as a spherical member more particularly referred to as a "ball", obviously, other equivalent elements such as cones, hemispheres or tapered plugs could be employed just so long as these elements have an outer tapered or curved lower surface adapted to engage with the upper tapered end of the bore of the seat. Also, the valve and retainer have been described as separate elements; if desired, however, the ball (or equivalent element) could be made integral with the retainer. Furthermore, the cage 20 has been described as having an annular ring 30 at its lower end; this may be the most expedient way to form the retainer and the retainer in this form may be the most stable configuration. However, it is contemplated that the retainer could be constructed without the lower annular end such that the legs 24, 26 and 28 could rest directly upon the seat. Still furthermore, the seat could be made integral with the top of the plunger.

What is claimed is:

1. A plunger for use in the pump barrel of a downhole pump comprising:

a substantially cylindrical body having a central longitudinal bore terminating at its upper end in a valve chamber and at its lower end in a venturi throat to enhance the rapid entry of well fluid into the bore;

a valve seat located at the upper end of the bore facing toward the valve chamber and having an opening therethrough of less diameter than the bore;

a valve element vertically reciprocable in the valve chamber, and adapted to seat on the valve seat upon an upward stroke of the cylindrical body in the pump barrel;

the valve chamber having a cross-sectional area sufficiently larger than the cross-sectional area of the bore to substantially reduce pressure build-up above the valve element upon downward movement of the cylindrical body within the pump barrel; and the cylindrical body configured to be slidably fitted within the pump barrel such that the seal provided by the slidably fitting metal surfaces of the cylindrical body and the pump barrel are positioned between the valve element and the lower end of the bore.

2. The plunger for a downhole pump as set forth in claim 1 wherein the valve seat is formed by a second venturi throat.

* * * * *